US012281458B2

(12) United States Patent
Unnebäck

(10) Patent No.: US 12,281,458 B2
(45) Date of Patent: Apr. 22, 2025

(54) LINKAGE ARRANGEMENT FOR A WORKING MACHINE

(71) Applicant: Volvo Construction Equipment AB, Eskilstuna (SE)

(72) Inventor: Joakim Unnebäck, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 5 days.

(21) Appl. No.: 17/897,660

(22) Filed: Aug. 29, 2022

(65) Prior Publication Data

US 2023/0070927 A1 Mar. 9, 2023

(30) Foreign Application Priority Data

Sep. 7, 2021 (EP) ..... 21195300

(51) Int. Cl.
*E02F 3/34* (2006.01)

(52) U.S. Cl.
CPC ..... *E02F 3/3411* (2013.01)

(58) Field of Classification Search
None
See application file for complete search history.

(56) References Cited

U.S. PATENT DOCUMENTS

| | | | | |
|---|---|---|---|---|
| 4,163,498 | A | 8/1979 | Grooss et al. | |
| 5,993,139 | A | 11/1999 | Deneve et al. | |
| 11,396,735 | B2 * | 7/2022 | Vigholm | B60T 8/26 |
| 2001/0053323 | A1 | 12/2001 | Godwin et al. | |
| 2003/0156937 | A1 | 8/2003 | Brown et al. | |
| 2014/0105715 | A1 | 4/2014 | Tracy et al. | |
| 2020/0370269 | A1 * | 11/2020 | Wagner | E02F 3/42 |

FOREIGN PATENT DOCUMENTS

| | | | |
|---|---|---|---|
| CN | 106120887 | A | 11/2016 |
| EP | 0818584 | A2 | 1/1998 |

OTHER PUBLICATIONS

Extended European Search Report dated Feb. 22, 2022 for European Patent Application No. 21195300.5, 8 pages.

* cited by examiner

*Primary Examiner* — Michael S Lowe
(74) *Attorney, Agent, or Firm* — Sage Patent Group

(57) ABSTRACT

A linkage arrangement for a working machine, the linkage arrangement being connectable to a work implement. The linkage arrangement includes a single boom lifting arm extending along a longitudinal centre axis and being configured to lift the work implement, and a tilting arrangement having two hydraulically driven arms arranged in parallel and being configured to tilt the work implement relative the single boom lifting arm. Each one of the two hydraulically driven arms is hydraulically driven by a separate hydraulic tilting cylinder.

12 Claims, 3 Drawing Sheets

LINKAGE ARRANGEMENT FOR A WORKING MACHINE

CROSS REFERENCE TO RELATED APPLICATIONS

The present application claims benefit of priority to European Patent Application No. 21195300.5, filed Sep. 7, 2021, and is assigned to the same assignee as the present application and is incorporated herein by reference.

TECHNICAL FIELD

The present disclosure relates to a linkage arrangement for a work implement for a working machine. The disclosure further relates to a working machine comprising such linkage arrangement, the working machine typically being a wheel loader.

BACKGROUND

Construction machines, or working machines, are configured to perform work by means of a work implement. For example, a working machine may be configured to lift, move and dump loads. An example of such working machine is a wheel loader, e.g. an articulated wheel loader.

The wheel loader typically comprises a work implement, such as a bucket, configured to handle the load. In order to move the work implement relative a frame of the working machine, the working machine is equipped with a linkage arrangement. The linkage arrangement comprises a load carrying structure, such as lifting arms, configured to lift the work implement. Moreover, the working machine may comprise some type of connector means, or coupler, configured to couple the working machine to various types of work implements.

The linkage arrangement has a large enclosure disposed forwardly of the operator's cab and centrally of the working machine, resulting in obstructed lines of sight when the operator is attempting to operate the work implement. The work implement in itself may also contribute to the obstructed lines of sight. Moreover, in order to handle the work implement properly, e.g. to tilt it, additional arms and actuators may be needed for proper torque distribution and desirable alignment of the work implement, which further contributes to the obstructed lines of sight.

Thus, there is a trade-off between good visibility for the driver, and satisfactory functionality of the work implement. There is thus a need in the industry for an improved linkage arrangement.

SUMMARY

It is an object of the present disclosure to at least to some extent alleviate the shortcomings discussed above in relation to the linkage arrangement.

According to at least a first aspect of the present disclosure, a linkage arrangement for a working machine, the linkage arrangement being connectable to a work implement, is provided. The linkage arrangement comprises a single boom lifting arm extending along a longitudinal centre axis and being configured to lift the work implement, and a tilting arrangement having two hydraulically driven arms arranged in parallel and being configured to tilt the work implement relative the single boom lifting arm, wherein each one of the two hydraulically driven arms is hydraulically driven by a separate hydraulic tilting cylinder.

Hereby, an improved linkage arrangement with regards to torque distribution relative the work implement, and visibility for the driver is provided. Moreover, the linkage arrangement combines parallel alignment with low weight in an advantageous manner. Stated differently, the configuration of the linkage arrangement provides a specific geometry between the linkage arrangement and the work implement having the advantages of a single boom lifting arm (e.g. good visibility in all positions and low weight), and the advantages of having two hydraulically driven arms arranged in parallel and separately hydraulically driven by a respective hydraulic cylinder for the tilting arrangement (e.g. torque distribution and parallel alignment). The linkage arrangement may be referred to as a boom loader mechanism. The work implement is typically an implement or attachment configured to perform work, and may be referred to as an attachment, or attached equipment.

As each one of the two hydraulically driven arms is hydraulically driven by a respective hydraulic tilting cylinder, the tilting arrangement may be referred to as being configured to be hydraulically driven by separate hydraulic cylinders.

According to at least one example embodiment, the linkage arrangement is connectable to the work implement by means of a coupler. The linkage arrangement may comprise the coupler, or the work implement may comprise the coupler. The coupler typically comprises a first attachment means to the single boom lifting arm and a second attachment means to each one of the two hydraulically driven arms. The coupler is according to at least one example embodiment configured to couple the working machine to various types of work implements.

According to at least one example embodiment, the two hydraulically driven arms are arranged at least partly outside of the single boom lifting arm in a direction traverse the longitudinal centre axis.

Hereby, the advantages of the configuration of the two hydraulically driven arms arranged in parallel and separately hydraulically driven by separate hydraulic cylinders, related to torque distribution and parallel alignment, are further improved. According to at least one example embodiment, the two hydraulically driven arms are arranged outside, such as wholly outside, of the single boom lifting arm in a direction traverse the longitudinal centre axis. According to at least one example embodiment, each one the two hydraulically driven arms extend along a respective longitudinal arm axis, wherein the two longitudinal arm axes are arranged parallel, or at least in parallel vertical planes, to the longitudinal centre axis of the single boom lifting arm. Typically, the longitudinal centre axis of the single boom lifting arm is arranged in between the two longitudinal arm axes.

According to at least one example embodiment, the single boom lifting arm is at least partly defined by two lateral sides extending on opposites sides of, and in the same direction as, the longitudinal centre axis, wherein the two hydraulically driven arms are arranged outside, or at least partly outside of, the lateral sides on opposite sides of the longitudinal centre axis.

According to at least one example embodiment, the hydraulic tilting cylinders are arranged at least partly outside of the single boom lifting arm in a direction traverse the longitudinal centre axis.

Hereby, the advantages of the configuration of the two hydraulically driven arms arranged in parallel and separately hydraulically driven by separate hydraulic cylinders, related to torque distribution and parallel alignment, are further improved. According to at least one example embodiment, the two hydraulic tilting cylinders are arranged outside, such as wholly outside, of the single boom lifting arm in a direction traverse the longitudinal centre axis. According to at least one example embodiment, each one the two hydraulic tilting cylinders extend in the same vertical plane as the corresponding previously mentioned longitudinal arm axes. Thus, the two hydraulic tilting cylinders may be referred to as being arranged parallel, or at least in parallel vertical planes, to the longitudinal centre axis of the single boom lifting arm. Typically, the longitudinal centre axis of the single boom lifting arm is arranged in between the hydraulic tilting cylinders.

According to at least one example embodiment, the two hydraulic tilting cylinders are arranged outside, or at least partly outside of, the lateral sides of the single boom lifting arm and on opposite sides of the longitudinal centre axis.

According to at least one example embodiment, the hydraulic tilting cylinders are arranged vertically below the longitudinal centre axis of the single boom lifting arm.

Such arrangement of the hydraulic tilting cylinders improves the torque distribution and parallel alignment of the tiling arrangement. Moreover, by having the hydraulic tilting cylinders arranged vertically below the longitudinal centre axis of the single boom lifting arm, the visibility for the driver is improved.

According to at least one example embodiment, each one of the two hydraulically driven arms comprises a first end connectable to the work implement, and comprises a second end connected to the corresponding hydraulic tilting cylinder.

The first end of each hydraulically drive arms is arranged on an opposite side of the corresponding second along the respective longitudinal arm axis. The hydraulic tilting cylinders are configured to transfer its induced motion to the respective second end of the hydraulically driven arms, wherein the induced motion is further transferred via the two hydraulically driven arms to their respective first end, to tilt the work implement. In other words, adjacent a first side lateral of the single boom lifting arm, a first hydraulic tilting cylinder is arranged and configured to transfer its induced motion to the second end of a first hydraulically driven arm, wherein the first hydraulically driven arm is configured to further transfer the induced motion to its first end, and adjacent a second side lateral of the single boom lifting arm, the second side being arranged on an opposite side of the single boom lifting arm compared to the first side in the travers direction, a second hydraulic tilting cylinder is arranged and configured to transfer its induced motion to the second end of a second hydraulically driven arm, wherein the second hydraulically driven arm is configured to further transfer the induced motion to its first end.

According to at least one example embodiment, each one of the two hydraulically driven arms comprises an intermediate portion arranged between the respective first and second ends, wherein each intermediate portion is rotationally coupled to the single boom lifting arm.

Hereby, each one of the two hydraulically driven arms is supported, and rotationally arranged relative to the single boom lifting arm. Thus, the torque distribution and parallel alignment of the tiling arrangement are improved.

According to at least one example embodiment, the intermediate portion is a first intermediate portion, and each one of the two hydraulically driven arms comprises a second intermediate portion arranged between the respective first end and first intermediate portion, wherein the second intermediate portion is rotationally coupled to the single boom lifting arm.

Hereby, each one of the two hydraulically driven arms is further supported, and additionally rotationally arranged relative to, the single boom lifting arm. Thus, the torque distribution and parallel alignment of the tiling arrangement are improved. For example, each one of the second intermediate portions is rotationally coupled to the single boom lifting arm via a respective spacer arm. Such spacer arm further improves the possibilities of transferring motion to the work implement by means of the tilting arrangement independently of the single boom lifting arm.

According to at least one example embodiment, the single boom lifting arm is hydraulically driven by a hydraulic lifting cylinder.

Thus, the single boom lifting arm is hydraulically driven by a separate hydraulic cylinder compared to the hydraulically driven arms of the tilting arrangement. Thus, the possibilities of independent motion of the single boom lifting arm and the tilting arrangement relative to the work implement are improved.

According to at least one example embodiment, the hydraulic lifting cylinder is arranged at least partly in the same horizontal plane as the hydraulic tilting cylinders.

Hereby, a concise, or compact, arrangement of the hydraulic cylinders (i.e. the two hydraulic tilting cylinders and the hydraulic lifting cylinder) is provided. According to at least one example embodiment, the hydraulic lifting cylinder is arranged in between the two hydraulic tilting cylinders as seen in a direction traverse the longitudinal central axis.

According to at least one example embodiment, each one of the hydraulically driven arms is linked arms comprising at least three straight sub-portions pivotably interconnected to each other.

Hereby, the configuration, and the torque distribution, of the tilting arrangement is improved. Thus, each one of the hydraulically driven arms comprises at least three straight sub-portions, or three arm-portions, pivotably interconnected to each other. Typically, the at least three straight sub-portions are pivotably connected to each other at the respective end portions of the straight sub-portions. For example, each one of the hydraulically driven arms comprises a first straight sub-portion having a first end portion connected to the corresponding hydraulic tilting cylinder, and having a second end portion arranged along the first straight sub-portion opposite the first end portion, wherein the second end portion is pivotally connected to a respective first end portion of a second straight sub-portion. Furthermore, each one of the second straight sub-portions comprises a second end portion arranged along the second straight sub-portion opposite the first end portion, etc. Thus, the second end of each one of the hydraulically driven arms is typically comprised in the respective first end portion of the first straight sub-portion, and the first end of each one of the hydraulically drive arms is typically comprised in the second end portion of the last of the straight sub-portions (e.g. the third straight sub-portion). According to at least one example embodiment, the respective first intermediate portion is arranged in the first straight sub-portion of the hydraulically driven arms. Additionally or alternatively, the respective second intermediate portion is arranged in the third straight sub-portion of the hydraulically driven arms. The hydraulically driven arms may be referred to as hydraulically driven arm arrangements or hydraulically driven linked-arms.

According to at least a second aspect of the present disclosure, a working machine comprising a linkage arrangement according to the first aspect of the disclosure is provided.

Effects and features of the second aspect of the disclosure are largely analogous to those described above in connection with the first aspect of the disclosure. Embodiments mentioned in relation to the first aspect of the disclosure are largely compatible with the second aspect of the disclosure, of which some are exemplified below.

According to at least one example embodiment, the working machine comprises a frame having a first attachment portion pivotably connecting the single boom lifting arm to the frame, wherein the hydraulic tilting cylinders are attached to the frame vertically below the first attachment portion. The frame may be referred to as the working machine frame.

According to at least one example embodiment, the working machine comprises the work implement. Thus, the linkage arrangement is connected to the work implement.

According to at least one example embodiment, the working machine is a wheel loader. According to at least one example embodiment, the work implement is a bucket.

Further advantages and features of the present disclosure are disclosed and discussed in the following description and the accompanying drawings.

BRIEF DESCRIPTION OF THE DRAWINGS

With reference to the appended drawings, below follows a more detailed description of embodiments of the disclosure cited as examples. In the drawings.

DETAILED DESCRIPTION

Figure 1:
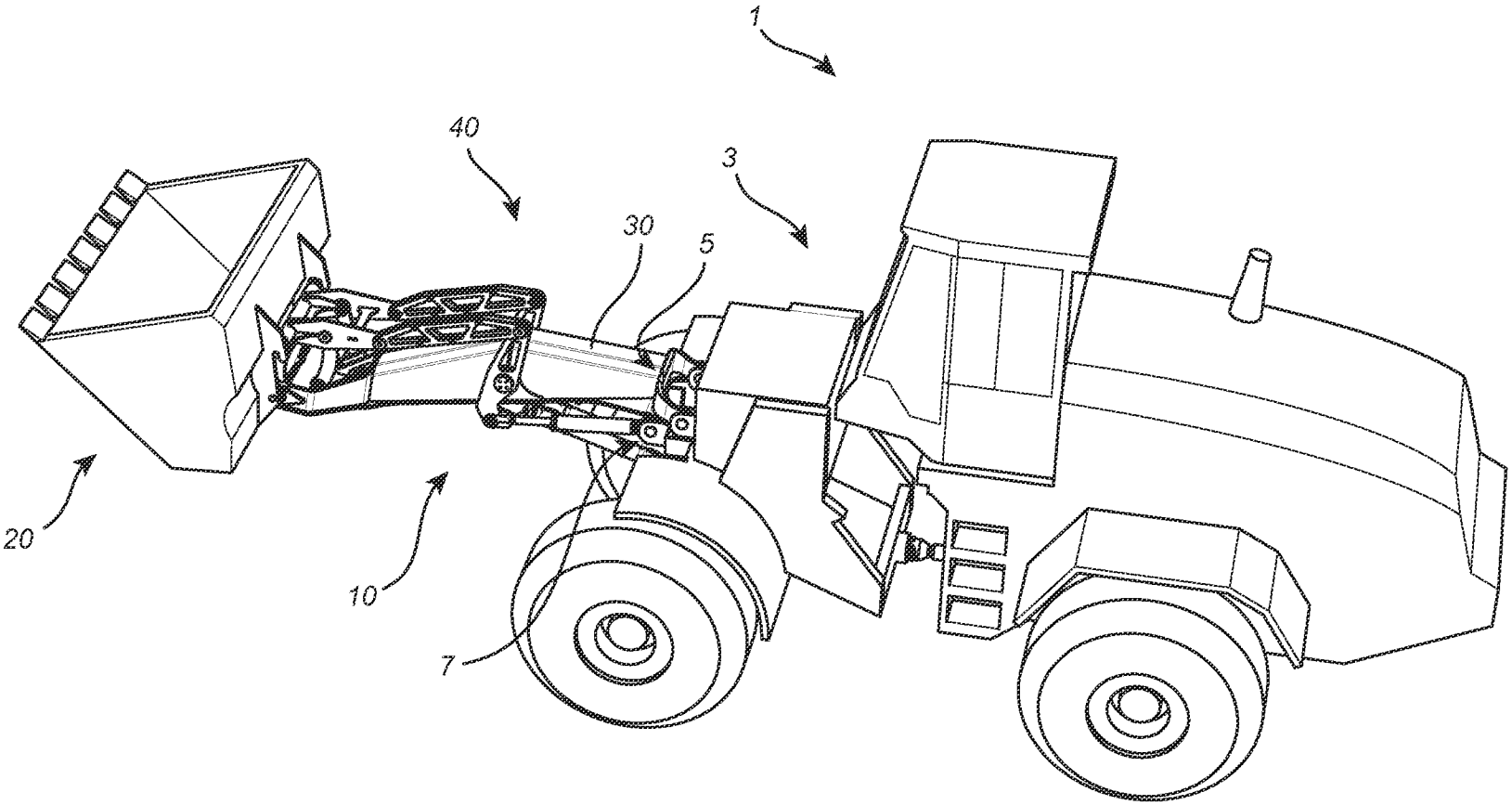
FIG. 1 is a schematic side view of a working machine comprising a linkage arrangement for a work implement in accordance with example embodiments of the disclosure.

With reference to FIG. 1, a working machine 1, here embodied as wheel loader 1, is disclosed for which linkage arrangement 10 of a kind disclosed in the present disclosure is advantageous. However, the linkage arrangement 10 may as well be implemented in other types of working machines, such as in e.g. an excavator. The working machine 1 may be an electric working machine, such as a full electric working machine or a hybrid, comprising at least one electric machine. Such electric machine may be powered by a rechargeable energy storage system, RESS, such as e.g. a battery system, or a fuel cell system.

As seen in FIG. 1, the linkage arrangement 10 is a connected to a work implement 20, here being a bucket 20. The linkage arrangement 10 comprises a single boom lifting arm 30 configured to lift the work implement 20, and a tilting arrangement 40 configured to tilt the work implement 20 relative the single boom lifting arm 30. The linkage arrangement 10 will now be described in further detail with reference to FIGS. 2-3.

Figure 2:
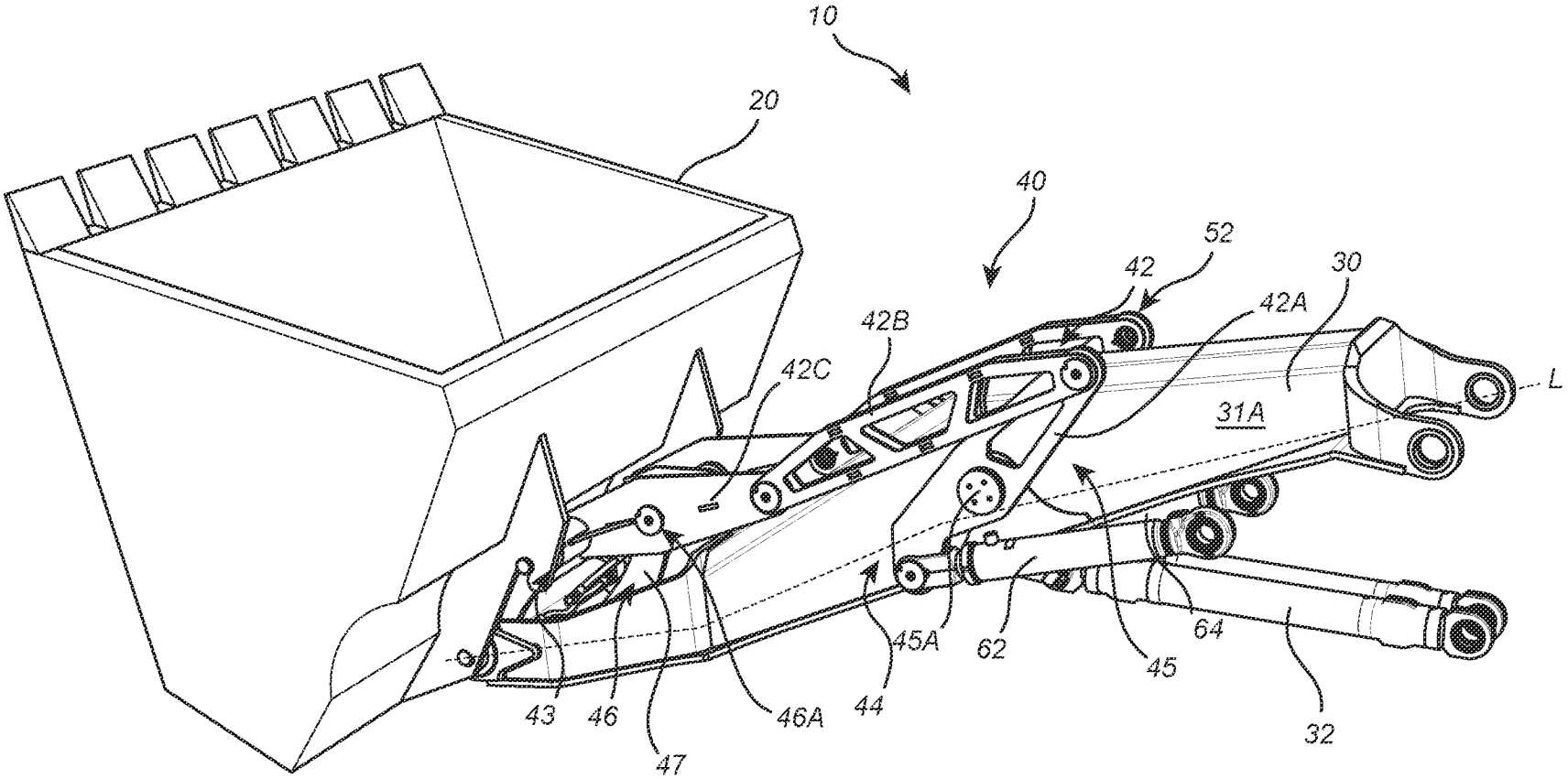
FIG. 2 is a schematic side view of a linkage arrangement and a work implement in accordance with an example embodiment of the disclosure.
Figure 3:
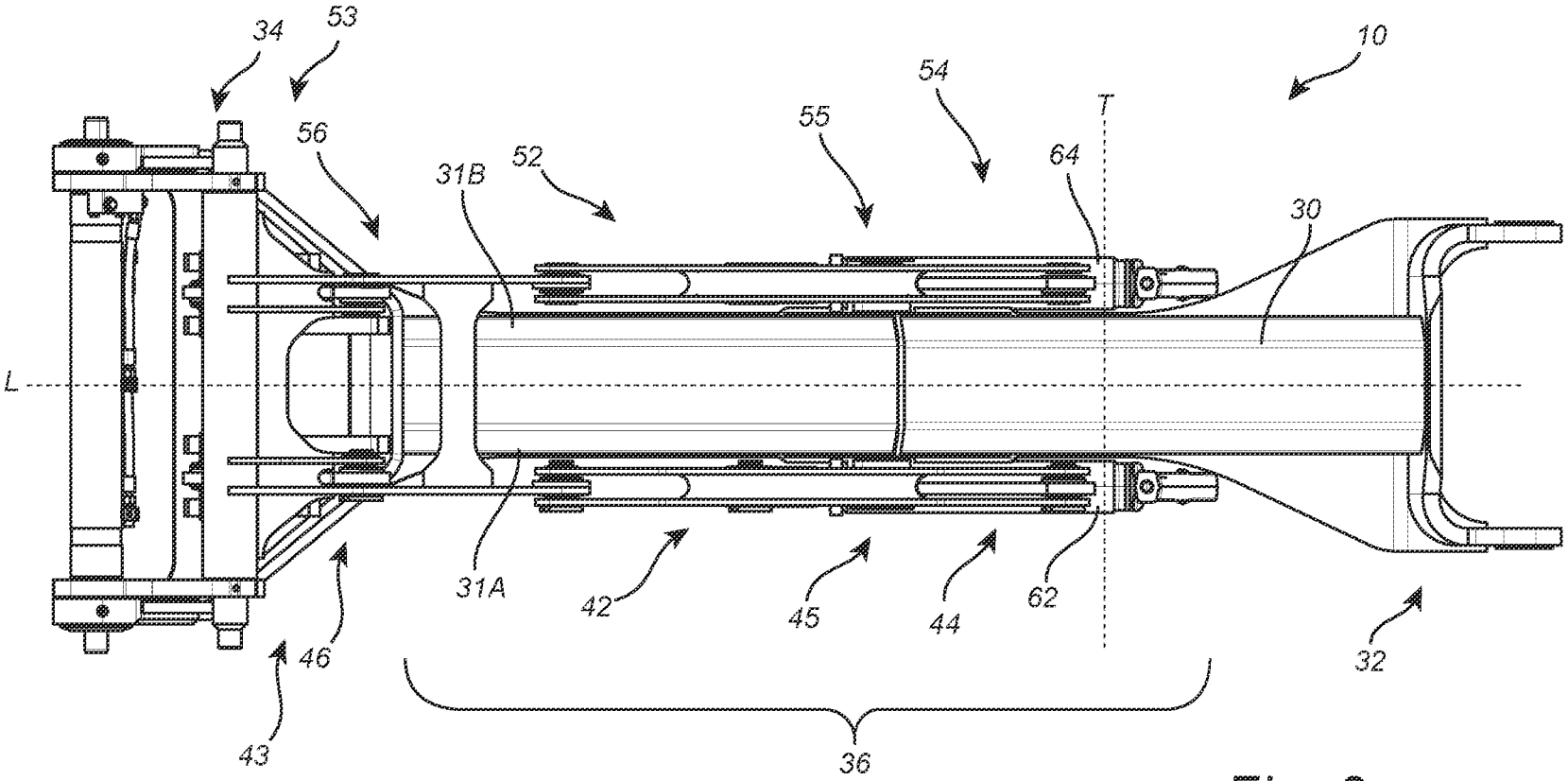
FIG. 3 is a schematic top view of the linkage arrangement of FIG. 2 without the work implement, in accordance with an example embodiment of the disclosure.

FIG. 2 is a schematic side view of the linkage arrangement 10 connected to the work implement 20 of FIG. 1, and FIG. 3 is a schematic top view of the same linkage arrangement 10 without the work implement 20. The embodiment shown in FIGS. 2-3 may thus be implemented in the working machine 1 of FIG. 1. As indicated in FIG. 1, the linkage arrangement 10 comprises a single boom lifting arm 30 and a tilting arrangement 40. The single boom lifting arm 30 extends along a longitudinal centre axis L. The single boom lifting arm 30 is not uniformly straight, but is slightly curved, or shaped by a finite number of combined straight segments. Thus, the longitudinal centre axis L of the single boom lifting arm is not forming a straight axis, but is an axis combined by a corresponding finite number of combined straight line segments, wherein the straight line segments are angled relative each other. In FIG. 2, the single boom lifting arm 30 is connected to, or attached to, the work implement 20 and is configured to lift the work implement 20, while the tilting arrangement 40 is connected to, or attached to, the work implement 20 and is configured to tilt the work implement 20. The tilting arrangement 40 is typically connected to, or attached to, the working implement 20 vertically above the position in which the single boom lifting arm 30 is connected to, or attached to, the working implement 20.

The tilting arrangement 40 of FIGS. 2-3 comprises two hydraulically driven arms 42, 52, here referred to as a first hydraulically driven arm 42 and a second hydraulically driven arm 52. As seen in at least FIG. 3, the first and second hydraulically driven arms 42, 52 are arranged in parallel and on different sides of the single boom lifting arm 30. Moreover, the tiling arrangement 40 comprises two hydraulic tilting cylinders 62, 64, here referred to as a first hydraulic tiling cylinder 62 and a second hydraulic tilting cylinder 64. The first hydraulic tilting cylinder 62 is configured to operate the first hydraulically driven arm 42, and the second hydraulic tilting cylinder 64 is configured to operate the second hydraulically driven arm 52, such that the working implement 20 is tilted relative the single boom lifting arm 30. Thus, each one of the two hydraulically driven arms 42, 52 is hydraulically driven by a separate hydraulic tilting cylinder 62, 64.

As best seen in FIG. 3, the first and the second hydraulically driven arms 42, 52 are arranged at least partly outside of the single boom lifting arm 30 in a direction traverse T the longitudinal centre axis L. The single boom lifting arm 30 comprises a first coupling portion 32 for coupling, or attachment, to the working machine 1, or a frame 3 of the working machine 1 (seen in FIG. 1), and comprises a second coupling portion 34 arranged along the longitudinal centre axis L on an opposite side of the single boom lifting arm 30 as compared to the first coupling portion 32, the second coupling portion 34 being configured for coupling, or attachment, to the work implement 20. The single boom lifting arm 30 further comprises a mid portion 36 making up a majority of the total length of the single boom lifting arm 30 along the longitudinal centre axis L. The mid portion 36 is arranged between the first coupling portion 32 and the second coupling portion 34, e.g. it may extend from the first coupling portion 32 to the second coupling portion 34. As can be seen in FIG. 3, the first and the second hydraulically driven arms 42, 52 are arranged outside of at least the mid portion 36 of the single boom lifting arm 30 in a direction traverse T the longitudinal centre axis L. Stated differently, and according to at least one example embodiment, the first and the second hydraulically driven arms 42, 52 are arranged outside the single boom lifting arm 30 in a direction traverse T the longitudinal centre axis L along at least a majority of the length of the single boom lifting arm 30 (the length being defined along the longitudinal centre axis L).

Correspondingly, and according to at least one example embodiment, the first and second hydraulic tilting cylinders 62, 64 are arranged at least partly outside of the single boom lifting arm 30 in a direction traverse T the longitudinal centre axis L. As can be seen in FIG. 3, the first and the second hydraulic tilting cylinders 62, 64 are arranged outside of at least the mid portion 36 of the single boom lifting arm 30 in a direction traverse T the longitudinal centre axis L. Stated differently, and according to at least one example embodiment, the first and the second hydraulic tilting cylinders 62, 64 are arranged outside the single boom lifting arm 30 in a direction traverse T the longitudinal centre axis L as compared to at least a majority of the length of the single boom lifting arm 30.

As seen in FIG. 2, the first and second hydraulic tilting cylinders 62, 64 are arranged vertically below the longitudinal centre axis L of the single boom lifting arm 30. That is, at least in a horizontal position of the linkage arrangement 10 (i.e. in a position in which the single boom lifting arm 30 is positioned to extend horizontally out from the frame 3 of the working machine 1), the first and second hydraulic tilting cylinders 62, 64 are arranged vertically below the longitudinal centre axis L of the single boom lifting arm 30.

The single boom lifting arm 30 may be described as being at least partly defined by two lateral sides 31A, 31B extending on opposites sides of, and in the same direction as, the longitudinal centre axis L. Thus, the first and second hydraulically driven arms 42, 52 are arranged outside of the lateral sides 31A, 31B on opposite sides of the longitudinal centre axis L. Correspondingly, the hydraulic tilting cylinders 62, 64 are arranged at least partly outside of the lateral sides 31A, 31B on opposite sides of the longitudinal centre axis L.

The positioning of the first and the second hydraulically driven arms 42, 52, and the first and second hydraulic tilting cylinders 62, 64, relative the single boom lifting arm 30 and its longitudinal centre axis L, provide an improved linkage arrangement 10 with regards to torque distribution relative the work implement 20, and visibility for the driver.

As seen in both FIGS. 2 and 3, each one of the first and second hydraulically driven arms 42, 52 comprises a first end 43, 53 connectable to the work implement 20, and comprises a second end 44, 54 connected to the corresponding hydraulic tilting cylinder 62, 64. That is, the first hydraulically driven arm 42 comprises a first end 43 connectable to the work implement 20, and comprises a second end 44 connected to the first hydraulic tilting cylinder 62. Correspondingly, the second hydraulically driven arm 52 comprises a first end 53 connectable to the work implement 20, and comprises a second end 54 connected to the second hydraulic tilting cylinder 64. Moreover, in the embodiment of FIGS. 2 and 3, each one of the first and second hydraulically driven arms 42, 52 comprises a first intermediate portion 45, 55 arranged between the respective first ends 43, 53 and second ends 44, 54. Each first intermediate portion 45, 55 is rotationally coupled to the single boom lifting arm 30. For the first hydraulically driven arm 42, this is shown in FIG. 2 as the rotational coupling 45A. A corresponding rotational coupling is arranged on the other lateral side 31B of the single boom lifting arm 30 for the second hydraulically driven arm 52. Moreover, each one of the first and second hydraulically driven arms 42, 52 comprises a second intermediate portion 46, 56 arranged between the respective first ends 43, 53 and first intermediate portions 45, 55. Each second intermediate portion 46, 56 is rotationally coupled to the single boom lifting arm. For the first hydraulically driven arm 42, this is shown in FIG. 2 as the rotational coupling 46A. A corresponding rotational coupling is arranged on the other lateral side 31B of the single boom lifting arm 30 for the second hydraulically driven arm 52. As seen in FIG. 2, the first hydraulically driven arm 42 is rotationally coupled to the single boom lifting arm by means of a spacer arm 47. A corresponding spacer arm is arranged on the other lateral side 31B of the single boom lifting arm 30 for the second hydraulically driven arm 52.

The single boom lifting arm 30 is hydraulically driven by a hydraulic lifting cylinder 32. The hydraulic lifting cylinder 32 is arranged along the longitudinal centre axis L, as is typically arranged vertically parallel to the single boom lifting arm 30. Moreover, and as can be seen in FIG. 2, the hydraulic lifting cylinder 32 is arranged at least partly in the same horizontal plane as the first and second hydraulic tilting cylinders 62, 64. Thus, the hydraulic lifting cylinder 32 is arranged in between the first and second hydraulic tilting cylinders 62, 64 as seen in a direction traverse T the longitudinal centra axis L. Hereby, a concise, or compact, arrangement of the hydraulic cylinders 32, 62, 64 is provided.

As best seen in FIG. 2, each one of the first and second hydraulically driven arms 42, 52 is linked arms 42, 52. In the following, the configuration of such linked arms 42, 52 is described with reference to the first hydraulically driven arm 42 only, but a corresponding configuration of the second hydraulically driven arm 52 is assumed. The first hydraulically driven arm 42 comprises at least three straight sub-portions 42A, 42B, 42C, here being referred to as a first straight sub-portion 42A, a second straight sub-portion 42B and a third straight sub-portion 43B, pivotably interconnected to each other. The straight sub-portions 42A, 42B, 42C may be referred to as arm-portions 42A, 42B, 42C. The first, second and third straight sub-portions 42A, 42B, 42C are pivotably connected to each other at the respective ends of the straight sub-portions 42A, 42B, 42C. For example, the first straight sub-portion 42A comprises a first end portion connected to the first hydraulic tilting cylinder 62, and comprises a second end portion arranged along the first straight sub-portion 42A opposite the first end portion, the second end portion being pivotally connected to a respective first end portion of the second straight sub-portion 42B. Furthermore, the second straight sub-portion 42B comprises a second end portion arranged along the second straight sub-portion 42B opposite the first end portion, the second end portion being pivotally connected to a first end portion of the third straight sub-portion 42C. Thus, the second end 44 of the first hydraulically driven arm 42 is typically comprised in the first straight sub-portion 42A and its first end portion, while the first end 43 of the first hydraulically driven arm 42 is comprised in the third straight sub-portion 42C and its second end portion. In case the first hydraulically driven arm 42 comprises a fourth straight sub-portion arranged after the third straight sub-portion 42C, the first end 43 of the first hydraulically driven arm 42 is typically comprised in the fourth straight sub-portion and its second end portion. Typically, the straight sub-portion of the first hydraulically driven arm 42 arranged closest to the work implement 20, or connection thereto, is referred to as the last straight sub-portion. As can be seen in FIG. 2, the first intermediate portion 45 of the first hydraulically driven arm 42 is arranged in the first straight sub-portion 42A, and the second intermediate portion 46 of the first hydraulically driven arm 42 is arranged in the third straight sub-portion 42C. The first and second hydraulically driven arms 42, 52 may be referred to as the first and second hydraulically driven arm arrangements or the first and second hydraulically driven linked-arms, respectively.

Turning briefly back to FIG. 1, showing the working machine 1 comprising the linkage arrangement 10 of FIGS. 2-3, and the work implement 20 in the form of a bucket 20. The working machine 1 comprises a frame 3 having a first attachment portion 5 pivotably connecting the single boom lifting arm 30 to the frame 3. Moreover, the frame 3 comprises a second attachment portion 7 connecting each one of the first and second hydraulic tilting cylinders 62, 64 to the frame 3. The second attachment portion 7 are arranged vertically below the first attachment portion 5.

It is to be understood that the present disclosure is not limited to the embodiments described above and illustrated in the drawings; rather, the skilled person will recognize that many changes and modifications may be made within the scope of the appended claims.

Additionally, variations to the disclosed embodiments can be understood and effected by the skilled person in practicing the claimed inventive concept, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A linkage arrangement for a working machine, the linkage arrangement being connectable to a work implement, the linkage arrangement comprises a single boom lifting arm extending along a longitudinal centre axis and being configured to lift the work implement, and a tilting arrangement having two hydraulically driven arms arranged in parallel and being configured to tilt the work implement relative the single boom lifting arm, wherein each one of the two hydraulically driven arms is hydraulically driven by a separate hydraulic tilting cylinder, wherein the hydraulic tilting cylinders are arranged at least partly outside of the single boom lifting arm in a direction traverse the longitudinal centre axis and the hydraulic tilting cylinders are arranged vertically below the longitudinal centre axis of the single boom lifting arm, and wherein each one of the hydraulically driven arms is linked arms comprising at least three straight sub-portions pivotably interconnected to each other.

2. The linkage arrangement according to claim 1, wherein the two hydraulically driven arms are arranged at least partly outside of the single boom lifting arm in a direction traverse the longitudinal centre axis.

3. The linkage arrangement according to claim 1, wherein each one of the two hydraulically driven arms comprises a first end connectable to the work implement, and comprises a second end connected to the corresponding hydraulic tilting cylinder.

4. The linkage arrangement according to claim 3, wherein each one of the two hydraulically driven arms comprises an intermediate portion arranged between the respective first and second ends, wherein each intermediate portion is rotationally coupled to the single boom lifting arm.

5. The linkage arrangement according to claim 4, wherein the intermediate portion is a first intermediate portion, and each one of the two hydraulically driven arms comprises a second intermediate portion arranged between the respective first end and first intermediate portion, wherein the second intermediate portion is rotationally coupled to the single boom lifting arm.

6. The linkage arrangement according to claim 1, wherein the single boom lifting arm is hydraulically driven by a hydraulic lifting cylinder.

7. The linkage arrangement according to claim 6, wherein the hydraulic lifting cylinder is arranged at least partly in the same horizontal plane as the hydraulic tilting cylinders.

8. A working machine comprising a linkage arrangement according to claim 1.

9. The working machine according to claim 8 comprising a frame having a first attachment portion pivotably connecting the single boom lifting arm to the frame, wherein the hydraulic tilting cylinders are attached to the frame vertically below the first attachment portion.

10. The working machine according to claim 8, further comprising the work implement.

11. The working machine according to claim 1, being a wheel loader.

12. The working machine according to claim 1, wherein the at least three straight sub-portions comprising a first straight sub-portion that includes a first end that connects to one of the hydraulic tilting cylinder, a second end that connects to a second straight sub-portion, and a rotational coupling between the first end and second end of the first straight sub-portion that rotationally connects the first straight sub-portion directly to the single boom lifting arm.

* * * * *